US007677141B1

(12) United States Patent
Crew

(10) Patent No.: US 7,677,141 B1
(45) Date of Patent: Mar. 16, 2010

(54) SOFT-GRIP, LOW-FORCE, HAND-HELD SPRING CLAMP

(76) Inventor: Sherri Kay Crew, 23575 N. Mill Creek Rd., Cicero, IN (US) 46034

( * ) Notice: Subject to any disclaimer, the term of this patent is extended or adjusted under 35 U.S.C. 154(b) by 0 days.

(21) Appl. No.: 12/218,217

(22) Filed: Jul. 11, 2008

Related U.S. Application Data

(60) Provisional application No. 60/958,986, filed on Jul. 11, 2007.

(51) Int. Cl.
*B25B 7/12* (2006.01)
*B25B 7/04* (2006.01)

(52) U.S. Cl. ..... 81/302; 81/409.5

(58) Field of Classification Search ..... 81/302, 81/427, 421–424, 6–8, 409.5, 485; 24/507, 24/510; 269/160
See application file for complete search history.

(56) References Cited

U.S. PATENT DOCUMENTS 2,667,678 A 2/1954 Hargrave et al.
2,766,649 A * 10/1956 Labry, Jr. ..... 81/423
3,263,535 A * 8/1966 Zurcher ..... 81/302
3,779,108 A * 12/1973 Reiter ..... 81/424
4,968,078 A * 11/1990 Fitzwater ..... 24/509
5,381,989 A * 1/1995 Jackson ..... 24/509
5,625,931 A 5/1997 Visser et al.
5,791,210 A * 8/1998 Wolff et al. ..... 81/302
6,185,795 B1 * 2/2001 Shui-Shang ..... 24/507
D442,047 S 5/2001 Hicks
6,223,665 B1 5/2001 Hindsley
6,240,815 B1 6/2001 Huang
D457,409 S 5/2002 Noniewicz
6,446,567 B2 9/2002 Hindsley
6,513,198 B2 * 2/2003 Lu ..... 81/427.5
D481,921 S 11/2003 Ben-Gigi
D487,688 S 3/2004 Brass et al.
6,711,789 B2 3/2004 Ping
6,827,103 B2 * 12/2004 Cheremshynski et al. ... 137/615
7,007,936 B2 3/2006 Chang
D519,812 S 5/2006 Weinberg et al.
7,048,174 B2 5/2006 Buchheit et al.

* cited by examiner

*Primary Examiner*—Hadi Shakeri
(74) *Attorney, Agent, or Firm*—Robert C. Montgomery

(57) ABSTRACT

A padded spring clamping device for making hand-crafted jewelry and similar activities comprising removable padded jaws and adjustable clamping force, is herein disclosed. The padding is of a closed-cell and chemical-resistant foam applied thereto the removable jaws in order to provide a soft covering that will protect fine jewelry, wood, or other items held within the jaws. The padding further provides increased frictional gripping ensuring that an item of varying size and shape is held with little or no movement.

15 Claims, 4 Drawing Sheets

SOFT-GRIP, LOW-FORCE, HAND-HELD SPRING CLAMP

RELATED APPLICATIONS

The present invention was first described in and claims the benefit of U.S. Provisional Patent No. 60/958,986 filed Jul. 11, 2007, the entire disclosures of which are incorporated herein by reference.

FIELD OF THE INVENTION

The present invention relates generally to a clamping device and, more particularly, to low-force hand-held spring clamp comprising soft and firm grips and an adjustable spring-tension clamping assembly.

BACKGROUND OF THE INVENTION

As anyone who performs a lot of physical work will attest nothing beats having the proper tool for a job. The proper tool can save time, save money, produce a higher quality job, reduce damage to equipment, and provide for the increased safety of the worker. One (1) such basic tool is the clamp. A clamp can be used on a temporary basis to hold pieces or parts together while gluing, fastening, or assembling them together. However, as useful as a clamp is, it is not without its disadvantages. Perhaps the biggest of these is the inability to softly, yet firmly hold an object in much the same manner as a human hand. Clamps also do not adept well to pieces or parts that are not completely flat or straight. Additionally, the constant pressure nature of most clamps ensures that a steady universal pressure is applied to the work piece whether it is required or not. Accordingly, there is a need for a means by which clamps can firmly yet softly hold pieces and parts without overdue pressure or non-adhering contact surfaces. The development of the invention herein described fulfills this need.

The present invention is a padded spring clamping device for making hand-crafted jewelry and similar activities comprising removable padded jaws and adjustable clamping force. The padding is of a closed-cell and chemical-resistant foam applied thereto the removable jaws in order to provide a soft covering that will protect fine jewelry, wood, or other items held within the jaws. The padding further provides increased frictional gripping ensuring that an item of varying size and shape is held with little or no movement. The invention possesses indicia for visually assessing the amount of applied force and a locking lever to maintain a desired level of force.

Several attempts have been made in the past to provide improved clamps. U.S. Pat. No. 7,048,174 issued to Buchheit et al. discloses an adjustable spring force clamping apparatus and method of use for elongated clamping members that appear to affix to a work surface. Unlike the present invention, the disclosed device does not appear to disclose a hand-held soft grip adjustable spring clamp.

U.S. Pat. No. 7,007,936 issued to Chang discloses a spring clamp with a locking type mechanism so that the clamp is not inadvertently dislodged from a work piece. Unlike the present invention, this device does not appear to disclose an adjustable, soft grip spring clamp.

U.S. Pat. No. 6,711,789 issued to Ping discloses a clamp with a locking mechanism. Unlike the present invention, this device does not appear to disclose an adjustable, soft grip spring clamp.

U.S. Pat. No. 6,446,567 issued to Hindsley discloses a portable hand-operated machine quilting clamp. Unlike the present invention, this device does not appear to disclose an adjustable, hand-held spring clamp.

U.S. Pat. No. 6,240,815 issued to Huang discloses a workpiece clamping device with a ratchet type mechanism. Unlike the present invention, this device does not appear to possess an adjustment mechanism or removably attachable jaw pads.

U.S. Pat. No. 6,223,665 issued to Hindsley discloses a quilt clamp. Unlike the present invention, this device does not appear to disclose an adjustable, hand-held spring clamp.

U.S. Pat. No. 5,625,931 issued to Visser and Bennett discloses a resilient clamp that appears to be two (2) force applying members that are opened by means of an interconnecting band. Unlike the present invention, this device does not appear to possess inter alia, a means of adjusting the force applied, removably attachable jaw pads or a locking lever.

U.S. Pat. No. 2,667,678 issued to Hargrave and Farmer discloses an adjustable hand clamp. Unlike the present invention, this device appears to utilize a different adjustment mechanism, does not possess indicia to visually indicate to the user the force applied and does not possess, inter alia, removably attachable jaw pads.

Numerous design patents exist for spring clamps such as U.S. Pat. No. D 442,047 issued to Hicks disclosing a needle-nose spring clamp, U.S. Pat. No. D 457,409 issued to Noniewicz disclosing a spring vice clamp with a soft grip, U.S. Pat. No. D 481,921 issued to Ben-Gigi disclosing a spring clamp, U.S. Pat. No. D 487,688 issued to Brass and Lewis disclosing a spring clamp and U.S. Pat. No. D 519,812 issued to Weinburg and Ruf disclosing a clamp-type hand tool. None of these cited patents appear to be similar in appearance to the disclosed invention nor do the cited patents appear to disclose an adjustable force, soft grip spring clamp that possesses removably attachable jaw pads.

None of the prior art particularly describes an adjustable force, soft grip spring clamp with removably attachable jaw pads and a locking lever for use in craft making or general shop use. Accordingly, there exists a need for a means by which items may be maintained and secured within the jaws of a spring clamp that is force adjustable and possesses removably attachable pads to conform to the item(s) being held by the clamp and that operates without the disadvantages as described above.

SUMMARY OF THE INVENTION

In view of the foregoing disadvantages inherent in the prior art, it has been observed that there is need for a soft grip low-force hand-held spring clamp which provides a padded spring clamping device to aid in the assembly of hand crafted jewelry, performing similar craft activities, and for general shop use.

To achieve the above objectives, it is an object of the present invention to provide a spring clamp comprising a left and right handle section, a center fulcrum, an adjustable force mechanism, removably attachable jaw pads and a locking lever.

An object of the soft grip, low-force hand-held spring clamp is to provide a means to maintain and secure for work fragile and delicate materials commonly used in areas such as hand crafted jewelry, crafts and shop activities.

Another object of the soft grip, low-force, hand-held spring clamp is to provide removably attachable firm jaw pads comprising a padded surface.

A further object of the soft grip, low-force, hand-held spring clamp provides a center fulcrum that permits a left and right side member to operate as conventional spring clamps.

Yet another object of the soft grip, low-force, hand-held spring clamp provides for removably attachable jaw pads affixed thereto hard clamping jaws and provide a soft covering that will not mar fine jewelry, wood, or other items held within the jaws. The padding further provides a compliant and high-friction grip that ensures that an item of varying size and shape is held with little or no movement.

Yet a further object of the soft grip, low-force, hand-held spring clamp provides that applied hand pressure to the device results in a separation of the jaw portions causing the jaw portions to move outwardly. A counteracting force to keep the jaw portions closed is provided by an adjustable force spring mechanism that causes the jaw portion to close thereupon a work object when the handle grip is released by the user.

Still another object of the soft grip, low-force, hand-held spring clamp provides for rotating attachment of the interchangeable jaw pads to the jaw portions to enable the clamping of items having various shapes and geometry.

Yet still another object of the soft grip, low-force, hand-held spring clamp provides an adjustable force spring mechanism that permits the amount of force applied to an object within the jaw pads to be adjusted by the user.

Another object of the soft grip, low-force, hand-held spring clamp is to provide a locking lever that will maintain the adjustable force spring mechanism in a desired user selected setting.

Still a further object of the soft grip, low-force, hand-held spring clamp comprises indicia located adjacent to the pressure adjustment knob to provide visual indication of the amount of force being applied to an item contained in the jaw portion of the device.

An aspect of the soft grip, low-force, hand-held spring clamp comprises a right side member and a left side member which rotate about a center fulcrum and are equipped with a handle grip to which hand pressure is applied.

Another aspect of the soft grip, low-force, hand-held spring clamp comprises a handle grip comprising a high-friction curved gripping surface that is molded or coated layers of soft plastic or rubber possessing a plurality of parallel grooves or ridges.

A further aspect of the soft grip, low-force hand-held spring clamp comprises a center fulcrum that provides an axle means to the device affixed at end portions to a pressure adjustment knob and second mounting plate. The center fulcrum axially attaches main components of the device; allows relative rotation of the right side and left side members; and provides a mounting means thereto the adjustable force spring mechanism.

Yet another aspect of the soft grip, low-force, hand-held spring clamp comprises a jaw portion that further comprises a removable and interchangeable jaw pad which is retained using a respective restraining pin. The removable and interchangeable jaw pads are pivotingly attached to the jaw portion via a recessed mounting slot located along a top edge region which slides down over side surfaces of a corresponding mounting protrusion portion of said jaw pad.

Yet still another aspect of the soft grip, low-force, hand-held spring clamp comprises multiple removable and interchangeable jaw pads to suit requirements of an object being clamped. The jaw pads would further comprise firm and softer jaw pads. The firm jaw pad is made of a hard, but non-marring material such as plastic or rubber being suitable for use on wood, finished steel, and the like, and for performing tasks such as gluing, assembling, and other purposes. The soft jaw pad is envisioned to be made of a pliable and conformable material such as closed cell polyurethane foam being suitable to perform tasks including holding fragile items such as glass, jewelry, and the like.

Another aspect of the soft grip, low-force, hand-held spring clamp comprises jaw pads attached to the respective jaw portion using a restraining pin. The restraining pins would be installed and removed by simply sliding said pin into a pin aperture portion of the jaw pad. Variations in the composition and style of the removable and interchangeable jaw pads are envisioned such as, but not limited to: a solid steel design for use in firm clamping of steel to be welded, wooden jaws for use in clamping of wood or similar fine finished material, rubber jaws for use in clamping of slick objects or objects that need to be insulated for electrical reasons, or soft pliable jaws made of low density foam for clamping of fragile objects, and as such should not be interpreted as a limiting factor of the invention.

Still a further aspect of the soft grip, low-force, hand-held spring clamp comprises a center fulcrum further comprising a pressure adjustment knob is provided in a centrally located position over the axis of the center fulcrum. The pressure adjustment knob is turned in a clockwise or counter clockwise direction to provide control of the pressure exerted by the removable and interchangeable jaw pads upon the work object. The left side member further comprises pressure adjustment indicia adjacent to the pressure adjustment knob to provide directional indication as to minimum and maximum pressure adjustments.

Yet still a further aspect of the soft grip, low-force, hand-held spring clamp comprises a center fulcrum further comprising an adjustable force spring mechanism that provides a selectable and variable clamping force applied items being held between the jaw portions. The adjustable force spring mechanism further comprises a pressure adjustment knob, a first mounting plate, a locking lever, and a torsion spring. The pressure adjustment knob is in mechanical communication with a torsion spring mounted along the outside surfaces of the center fulcrum and anchored thereto. As the pressure adjustment knob is turned, the torsion spring is further coiled producing a torsion which is in-turn applied thereto the right side member Once the pressure adjustment knob is positioned at a desired point, the locking lever is engaged to secure the pressure adjustment knob in position such that it cannot move.

A further aspect of the soft grip, low-force, hand-held spring clamp comprises a second mounting plate which further comprises a circular disc being permanently affixed to an outer surface of the left side member. The second mounting plate provides a terminating attachment means to the center fulcrum in-turn providing rotating attachment of the right side and left side members.

A method of utilizing the soft grip, low-force, hand-held spring clamp may be achieved by performing the following steps: determining a desired pair of removable and interchangeable jaw pads to use with the device dependent on the physical characteristics of the material being clamped; removing the restraining pins from the jaw portions; sliding the mounting protrusions into the recessed mounting slot portions of the jaw portions of the device; replacing the restraining pin into the pin apertures; determining a necessary pressure to be provided by the device to the clamped item; using a trial and error method, the user would turn the pressure adjustment knob in a clockwise or counterclockwise direction using the pressure adjustment indicia until the desired pressure is reached; locking the pressure adjustment knob in place by rotating the locking lever in a clockwise direction; applying a hand pressure to the handle grip to open the jaw portions; using the device to clamp an item or a plurality of items based upon a particular craft or shop task; releasing said hand pressure applied thereto the handle grip to close the interchangeable jaw pads upon the clamped item; removing the device by reversing the above procedure; repeating as needed based on an occurrence of clamping tasks; and, benefiting from secure and safe clamping of various items using the soft grip, low-force, hand-held spring clamp.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
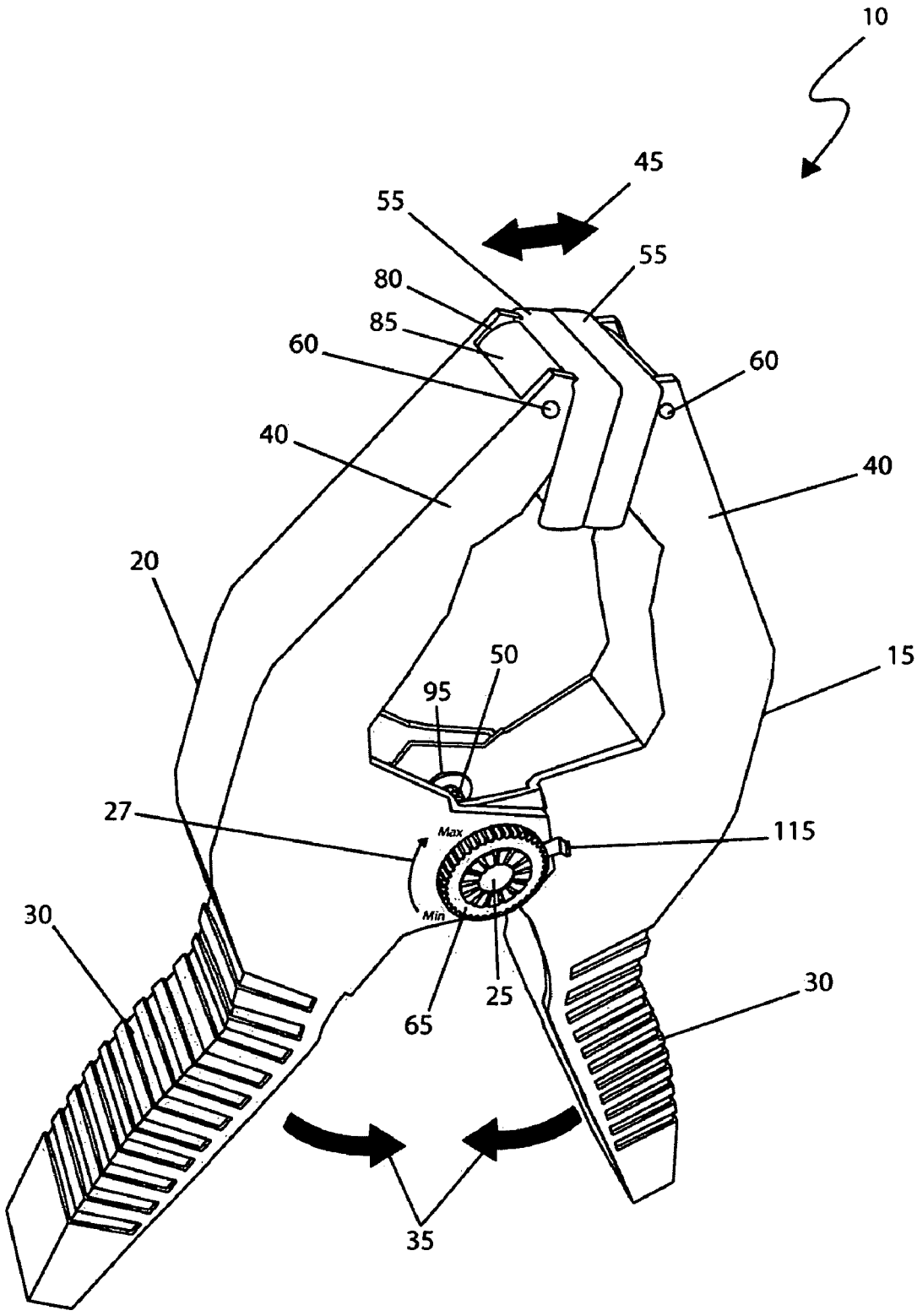
FIG. 1 is a perspective view of a soft grip low-force hand-held spring clamp 10, according to the preferred embodiment of the present invention.

10 soft grip low-force hand-held spring clamp
15 right side member
20 left side member
25 center fulcrum
27 pressure adjustment indicia
30 handle grip
35 first direction arrow
40 jaw portion
45 second direction arrow
50 adjustable force spring mechanism
55 removable and interchangeable jaw pads
60 restraining pin
62 pin aperture
65 pressure adjustment knob
70 firm jaw pad
75 soft jaw pad
80 recessed mounting slot
85 mounting protrusions
95 first mounting plate
97 second mounting plate
115 locking lever
116 lever washer
117 incline plane
120 torsion spring

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and that example configurations shall be shown and described for purposes of clarity and disclosure and not by way of limitation of scope.

The terms "a" and "an" herein do not denote a limitation of quantity, but rather denote the presence of at least one of the referenced items.

The present invention describes a soft grip low-force hand-held spring clamp (herein described as the "device") 10, which provides a padded spring clamping device, to aid in the assembly of hand crafted jewelry, performing similar craft activities, and for general shop use. The clamping device 10 comprises removably attachable firm jaw pads 55 comprising a padded surface. The padding is of a closed-cell construction and impervious to most chemical compounds. The jaw pads 55 are affixed thereto hard clamping jaws 40 and provide a soft covering that will not mar fine jewelry, wood, or other items held within the jaws. The padding further provides a compliant and high-friction grip that ensures that an item of varying size and shape is held with little or no movement.

Referring now to FIG. 1, a perspective view of the device 10 according to the preferred embodiment of the present invention is disclosed. The device 10 comprises a right side member 15 and a left side member 20 which rotate about a center fulcrum 25. Said right side 15 and left side 20 members are envisioned being similar to conventional "spring clamp" or a "pony clamp" mechanisms. The center fulcrum 25 provides an axle means to the device 10 being terminated and affixed at end portions thereto the pressure adjustment knob 65 and second mounting plate 97 (see FIG. 4). The center fulcrum 25 axially attaches main components of the device 10; allows relative rotation of the right side 15 and left side 20 members; and provides a mounting means thereto the adjustable force spring mechanism 50 (see FIG. 3). The right side member 15 and the left side member 20 are equipped with a handle grip 30 to which hand pressure is applied in a direction as indicated by a first direction arrow 35. The handle grip 30 comprises high-friction curved gripping surfaces envisioned to be molded or coated layers of soft plastic or rubber having a plurality of parallel grooves or ridges. The applied hand pressure results in a separation of the jaw portions 40 moving outwardly as defined by a second direction arrow 45. A counteracting force to keep the jaw portions 40 closed is provided by an adjustable force spring mechanism 50 (see FIG. 3). Said counteracting force causes the jaw portion 40 to close thereupon a work object when the handle grip 30 is released by the user. Each jaw portion 40 is furnished with a removable and interchangeable jaw pad 55 which is retained using a respective restraining pin 60. The removable and interchangeable jaw pads 55 are pivotingly attached thereto the jaw portion 40 via a recessed mounting slot 80 located along a top edge region which slides down over side surfaces of a corresponding mounting protrusion 85 portion of said jaw pad 55 (see FIG. 2). The rotating attachment of the interchangeable jaw pads 55 thereto the jaw portions 40 enables a compliant inclusive angle to be achieved therebetween, for clamping items having various shapes and geometry. A pressure adjustment knob 65 is provided in a centrally located position over the axis of the center fulcrum 25. The pressure adjustment knob 65 is turned in a clockwise or counter-clockwise direction to provide control of the pressure exerted by the removable and interchangeable jaw pads 55 thereupon the work object. The left side member 20 further comprises pressure adjustment indicia 27 being printed or etched thereupon and positioned adjacent thereto the pressure adjustment knob 65, thereby providing a directional indication as to minimum and maximum pressure adjustments. The device 10 would be constructed using well known plastic injection molding or metal stamping methods along with mass production assembly technologies.

Figure 2:
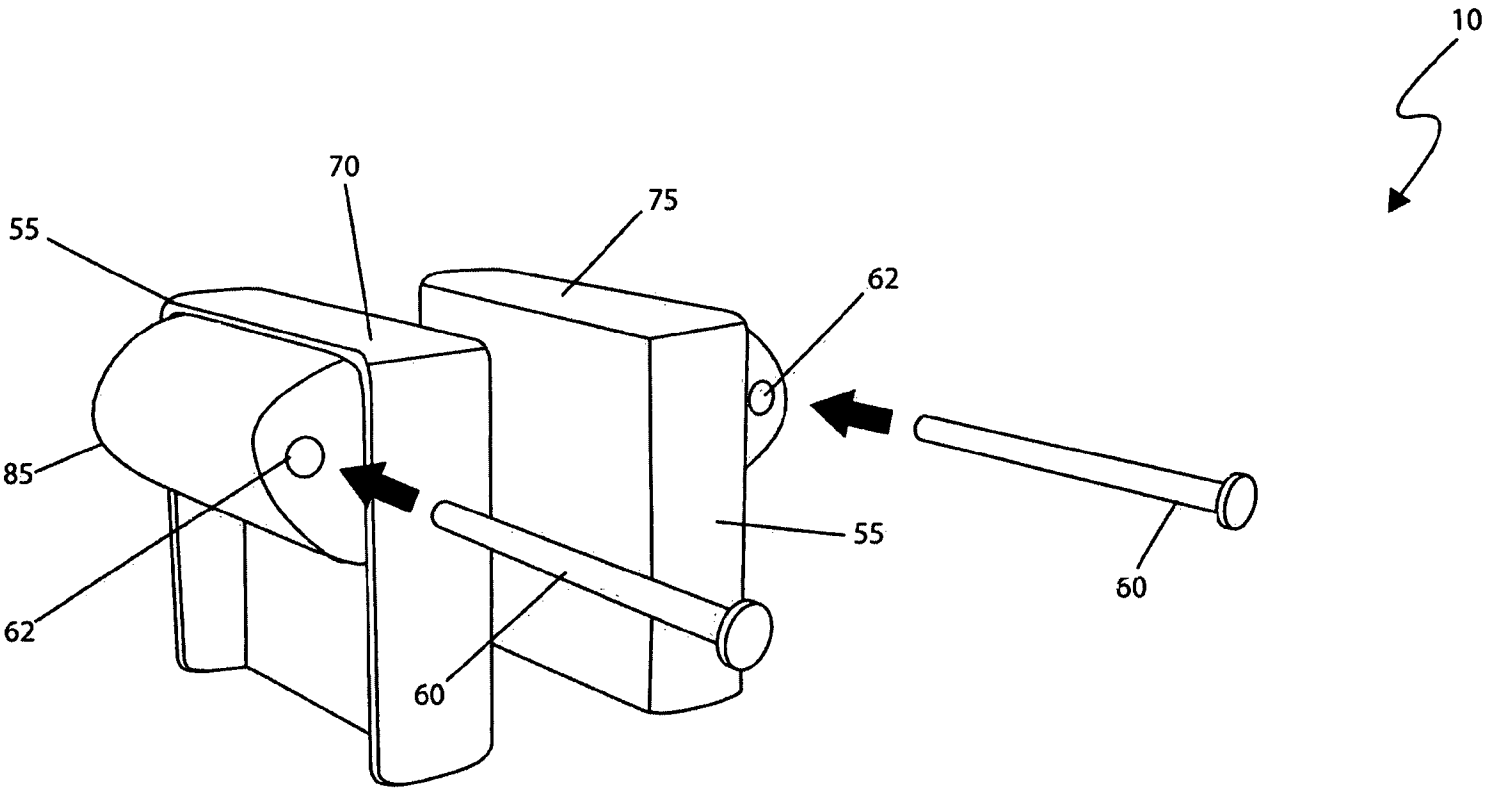
FIG. 2 is a close-up view of the interchangeable jaw pad portions 55 of the soft grip low-force hand-held spring clamp 10, according to the preferred embodiment of the present invention.

Referring now to FIG. 2, a close-up view of the interchangeable jaw pad portions 55 of the device 10, according to the preferred embodiment of the present invention is disclosed. It is envisioned that the device 10 would be provided with multiple removable and interchangeable jaw pads 55 to suit requirements of an object being clamped. The jaw pads 55 shown here depict a particular configuration comprising a firm jaw pad 70 and a soft jaw pad 75 along with their removal and replacement means. The firm jaw pad 70 is envisioned to be made of a hard, but non-marring material such as plastic or rubber being suitable for use on wood, finished steel, and the like, for performing tasks such as gluing, assembling, and other purposes. The soft jaw pad 75 is envisioned to be made of a pliable and conformable material such as closed cell polyurethane foam being suitable to perform tasks including holding fragile items such as glass, jewelry, and the like. Each jaw pad 55 provides an attachment means thereto the respective jaw portion 40 using a restraining pin 60. The restraining pins 60 would be installed and removed by simply sliding said pin 60 using one's fingers therein a pin aperture 62 portion of the jaw pad 55 and therethrough a corresponding pin aperture thereof each jaw portion 40 of the left side member 20 and right side member 15. The pin apertures 62 are sized so as to provide a retaining friction fit thereto said restraining pins 60. Additional variations thereto the composition and style of the removable and interchangeable jaw pads 55 are envisioned such as, but not limited to: a solid steel design for use in firm clamping of steel to be welded, wooden jaws for use in clamping of wood or similar fine finished material, rubber jaws for use in clamping of slick objects or objects that need to be insulated for electrical reasons, or soft pliable jaws made of low density foam for clamping of fragile objects, and as such should not be interpreted as a limiting factor of the invention 10. It is also envisioned that said additional jaw pad designs 55 may be purchased with the device 10 or purchased separately as optional components. The composition and type of material used on each jaw pad 55 may be the same or different dependent thereupon particular materials being clamped. The removable and interchangeable jaw pads 55 engage therewith the jaw portion 40 via an integral mounting protrusion 85 located along a rear surface of said jaw pad 55 (see FIG. 1).

Figure 3:
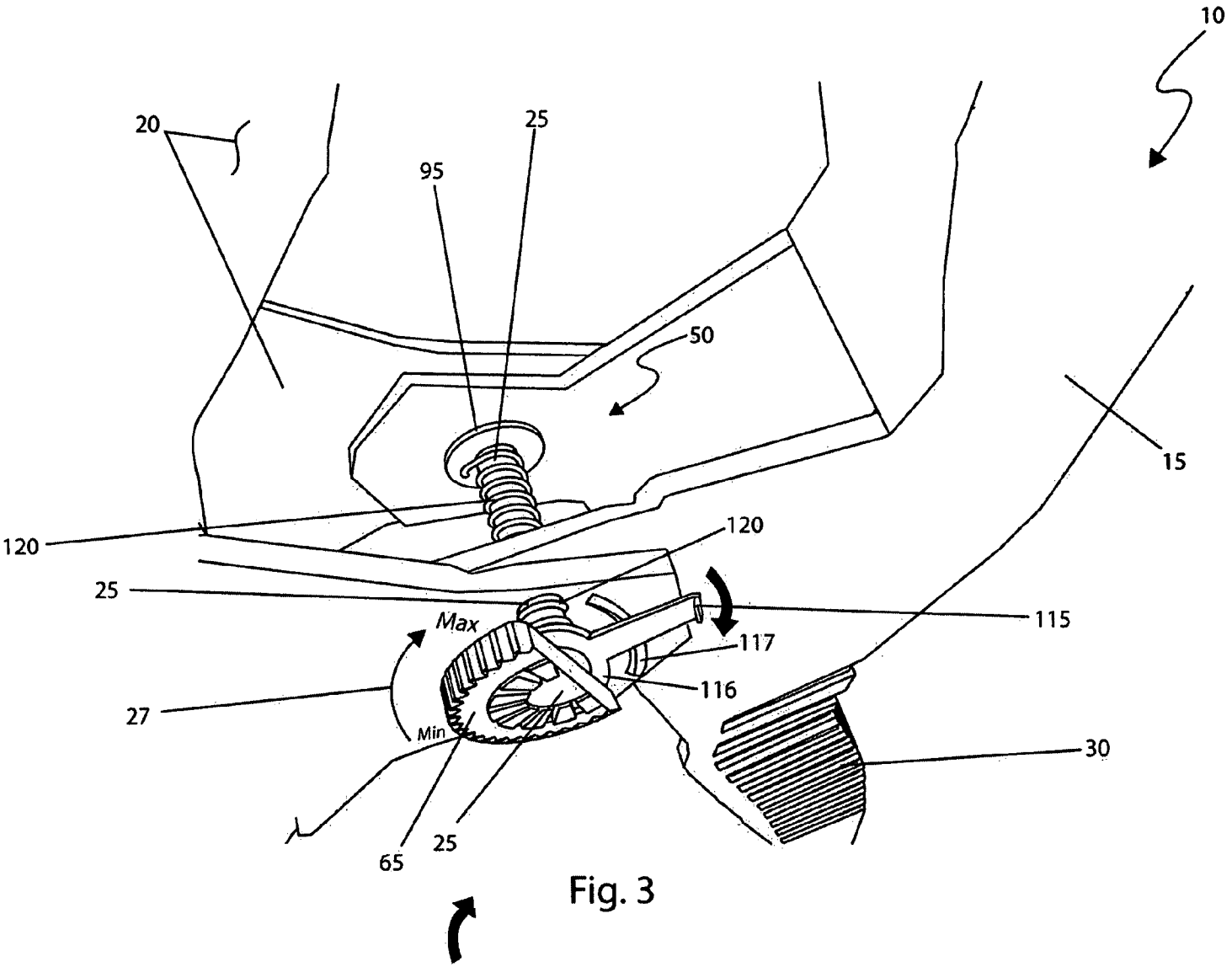
FIG. 3 is a detailed perspective view of the adjustable force spring mechanism 50 portion of the soft grip low-force hand-held spring clamp 10, according to the preferred embodiment of the present invention; and, FIG. 4 is a rear perspective view of the device 10, according to the preferred embodiment of the present invention.

Referring now to FIG. 3, a detailed perspective view of the adjustable force spring mechanism 50 portion of the device 10, according to the preferred embodiment of the present invention is disclosed. The adjustable force spring mechanism 50 provides a selectable and variable clamping force applied thereto one (1) or more items being held therebetween the jaw portions 40. The adjustable force spring mechanism 50 comprises a pressure adjustment knob 65 (cut-away for illustration), a first mounting plate 95, a locking lever 115, and a torsion spring 120. The pressure adjustment knob 65 is in mechanical communication therewith a torsion spring 120 which is mounted along outside surfaces of the center fulcrum 25 and is anchored thereto said center fulcrum 25. As such, as the pressure adjustment knob 65 is turned, the torsion spring 120 is further coiled producing a torsion which is in-turn applied thereto the right side member 15 via the affixed first mounting plate 95 being permanently attached thereto the right side member 15 preferably using plastic or metal welding. Thus, the revolutions contained by the torsion spring 120 as well as the pressure exerted by it against the right side member 15 thereto the left side member 20, are varied. Once the pressure adjustment knob 65 is positioned at a desired point, the locking lever 115 is engaged to secure the pressure adjustment knob 65 in position such that it cannot move or rotate in relation to either the right side member 15 or the left side member 20. The locking lever 115 further comprises an integral lever washer 116 mounted thereto the centers fulcrum 25 via an expected central aperture. The left side member 20 comprises an integral incline plane feature along an outer surface being subjacent thereto the locking lever 115. As the locking lever 15 is rotated clockwise about the center fulcrum 25, the incline plane 117 forces the locking lever 115 against a bottom surface of the adjustment knob 65 providing a locking friction thereto. As such, the above described adjustable force spring mechanism 50 provides a key feature of the device 10. Through the use of the adjustable force spring mechanism 50, the user is able to adjust a force applied by the device 10 to the object being clamped. At the lowest selected pressure, the device 10 applies only enough force that is needed to hold the desired object in place being in sharp contrast thereto conventional clamps which apply a predetermined pressure. At its highest or maximum pressure, the device 10 applies a high level of pressure to ensure that the clamped object does not move. Said maximum pressure is envisioned to provide a greater force thereto the clamped item as compared thereto conventional clamps which may not be capable of holding the desired object secure.

Figure 4:
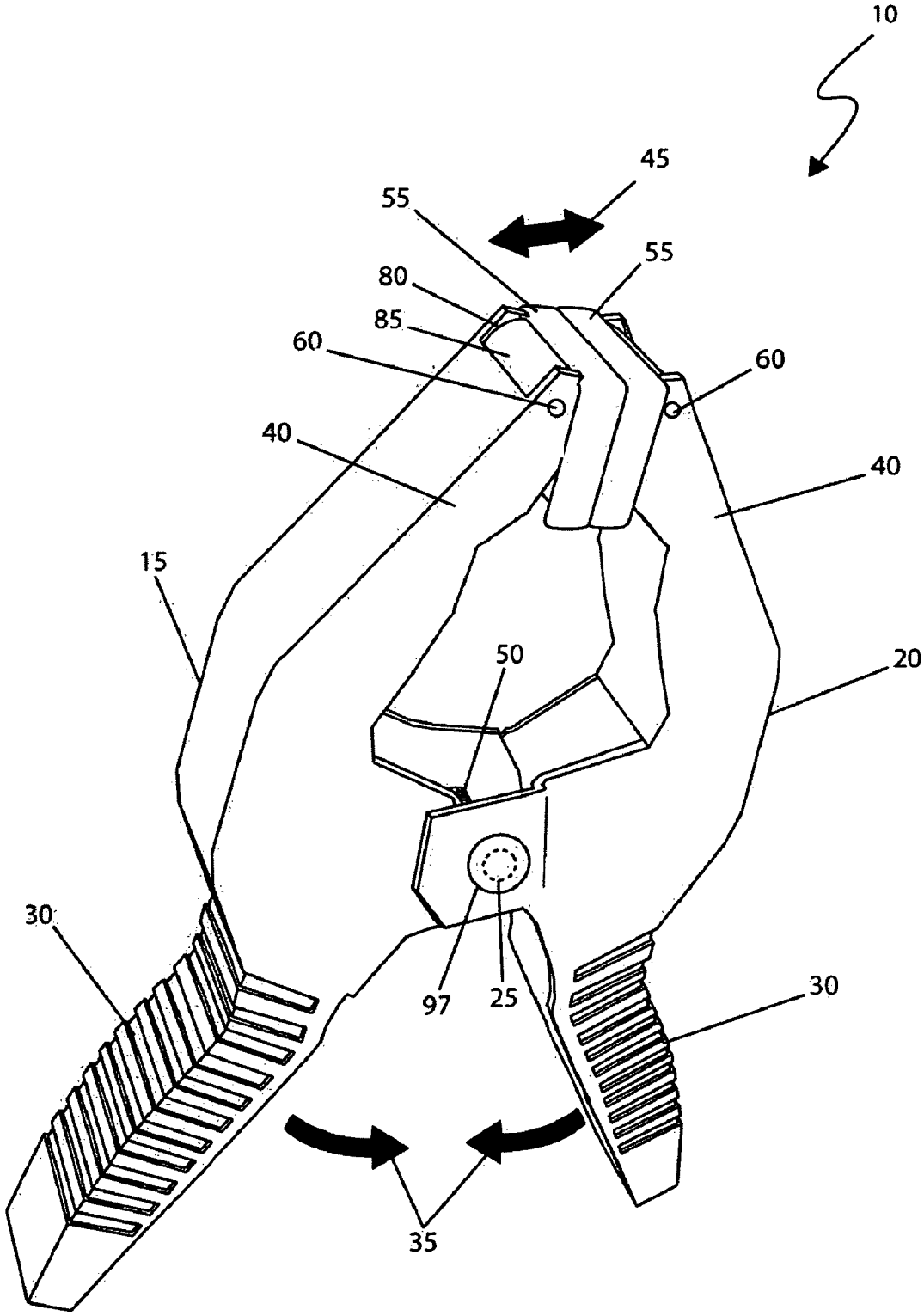

Referring now to FIG. 4, a rear perspective view of the device 10, according to the preferred embodiment of the present invention is disclosed. The device 10 comprises a second mounting plate 97 which further comprises a circular disc being permanently affixed thereto an outer surface of the left side member 20 preferably using a plastic or metal welding process. The second mounting plate 97 provides a terminating attachment means thereto the center fulcrum 25 in-turn providing rotating attachment of the right side 15 and left side 20 members therealong said center fulcrum 25.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed and utilized as indicated in FIGS. 1 and 2.

The method of utilizing the preferred embodiment of the device 10 may be achieved by performing the following steps: determining a desired pair of removable and interchangeable jaw pads 55 to use with the device 10 dependent on the material being clamped; removing the restraining pins 60 therefrom the jaw portions 40; sliding the mounting protrusions 85 thereinto the recessed mounting slot 80 portions of the jaw portions 40 of the device 10; replacing the restraining pin 60 thereinto the pin apertures 62; determining a necessary pressure to be provided by the device 10 thereto the clamped item; using a trial and error method, the user would turn the pressure adjustment knob 65 in a clockwise or counter-clockwise direction using the pressure adjustment indicia 27 until the desired pressure is reached; locking the pressure adjustment knob 65 in place by rotating the locking lever 115 in a clockwise direction; applying a hand pressure to the handle grip 30 in accordance with the first direction arrow 35 to open the jaw portions 40; using the device 10 to clamp an item or a plurality of items based upon a particular craft or shop task; releasing said hand pressure applied thereto the handle grip 30 to close the interchangeable jaw pads 55 thereupon the clamped item; removing the device 10 by reversing the above procedure; repeating as needed based on an occurrence of clamping tasks; and, benefiting from secure and safe clamping of various items using the present invention 10.

Selection of particular interchangeable jaw pads 55 by a user is envisioned to take place as follows: harder, durable and structurally sound objects would use jaw pads 55 of a similar nature such that more force can be exerted. More softer, weak and fragile items would use jaw pads 55 of a similar nature such that surface abnormalities can be absorbed by the removable and interchangeable jaw pads 55 without destroying the object being clamped. It is further understood that the device 10 may be configured using a pair of jaw pads 55 having differing compliant compositions such as in cases where clamped items comprise different finishes and/or surfaces thereupon.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A hand-held spring clamp which provides an aid in an assembly of a work object comprising:

a right side member with a removably attachable pad attachment means at a right jaw portion at a right upper end, further comprising:

a first right flange located at said central location;

a second right flange located at said central location;

a first mounting plate located on a front side of said second right flange; and, a right handle portion;

a left side member with a removably attachable pad attachment means at a left jaw portion located at left upper end, further comprising:

a first left flange located at said central location;

a second left flange located at said central location;

a second mounting plate located on a rear surface of said second left flange; and, a left handle portion;

a removable and interchangeable jaw pad attachable thereto said right and left jaw portions therewith said pad attachment means;

a center fulcrum providing a pivoting means thereto a central location thereof each said left side member and said right side member; and, a pressure adjustment means affixed thereto said center fulcrum, further comprising:

said pressure adjustment knob mounted thereto a centrally located position about an axis of said first end of said center fulcrum;

a torsion spring in mechanical communication therewith said pressure adjustment knob at a first end and mounted along an outside surface of said center fulcrum and is anchored thereto;

said first mounting plate affixed thereto said center fulcrum at a second end of said torsion spring;

a locking lever comprising a lever washer mounted thereto said center fulcrum adjacent thereto said pressure adjustment knob; and, an incline plane feature along a front surface thereof said first left flange such that said incline plane is subjacent thereto said locking lever;

wherein said clamp provides a compliant high-friction grip that ensures that said work object of varying size and shape is held with minimal or no movement;

wherein said first and second left flange comprise a width enabling said first and second left flange to bracket said first and second right flange;

wherein said first and second left flanged portion and said first and second right flanged portion each comprise apertures thereby allowing said center fulcrum to pass therethrough and provide a connection means thereof said second mounting plate thereof said left side member to said first mounting plate thereof right side member;

wherein said center fulcrum terminates at a first end thereto a pressure adjustment knob and at a second end thereto said second mounting plate;

wherein said center fulcrum provides relative motion thereof said right side member and left side member;

wherein an applied pressure thereto said right and left side members provides a separating means thereto said left jaw portion and said right jaw portion;

wherein said pressure adjustment knob is manually adjusted between a maximum force and a minimum in a clockwise or counter-clockwise direction to provide minute variations of an applied pressure exerted by said jaw pads thereupon said work object;

wherein when said pressure adjustment knob is manually adjusted, said torsion spring is compressed or released, thereby producing a variable torsion applied thereto said right side member via said first mounting plate;

wherein said locking lever provides a securing means thereto a desired torsion thereof said variable torsion thereto said clamp;

wherein when said locking lever is rotated clockwise about said center fulcrum, said incline plane forces said locking lever against a bottom surface of said pressure adjustment knob, thereby providing said securing means thereto; and, wherein said applied pressure is exerted by said jaw pads when said right handle and left handle portions are released; and, wherein said pressure adjustment means provides a selectable and variable clamping means thereto a work object.

2. The clamp of claim 1, wherein each said left and right side member further comprises a handle grip.

3. The clamp of claim 2, wherein said handle grip further comprises a high-friction curved gripping surface having molded or coated layers of a soft pliable and gripping material having a plurality of parallel grooves or ridges.

4. The clamp of claim 1, wherein said pad attachment means for each said right and left side members further comprises:

a mounting protrusion located on a rear portion thereof said jaw pad;

a pin aperture thereof said mounting protrusion; and, a restraining pin;

wherein said restraining pin is routed therethrough a pin aperture thereof a recessed mounting slot thereof said left and right jaw portions and said pin apertures, thereby providing said pad attachment means;

wherein said pad attachment means provide a pivoting attachment thereof said jaw pad thereto said left and right jaw portions, thereby providing a compliant inclusive angle to be achieved therebetween.

5. The clamp of claim 4, wherein said jaw pads each comprise a firm jaw pad.

6. The clamp of claim 5, wherein said firm jaw pad comprises a hard and non-marring material being suitable for performing tasks on said work object comprising rigid and durable materials.

7. The clamp of claim 4, wherein said jaw pads each comprise a soft jaw pad.

8. The clamp of claim 7, wherein said soft jaw pad comprises a pliable and conformable material being suitable to performing tasks on said work object comprising fragile materials.

9. The clamp of claim 1, wherein said left side member further comprises pressure adjustment indicia being printed or etched thereupon and positioned adjacent thereto said pressure adjustment knob, thereby providing a directional indication as to minimum and maximum pressure adjustments.

10. A hand-held spring clamp which provides an aid in an assembly of a work object comprising:

a right side member further comprising:

a removably attachable pad attachment means at a right jaw portion at a right upper end;

a first right flange located at a right central location;

a second right flange located at said central location;

a first mounting plate located on a front side of said second right flange; and, a right handle portion having a right handle grip;

a left side member further comprising:

a removably attachable pad attachment means at a left jaw portion located at left upper end;

a first left flange located at a left central location;

a second left flange located at said central location;

a second mounting plate located on a rear surface of said second left flange; and, a left handle portion having a left handle grip;

a center fulcrum providing a pivoting means thereto said right and left central location;

a pressure adjustment means affixed thereto said center fulcrum, further comprising:

said pressure adjustment knob mounted thereto a centrally located position about an axis of said first end of said center fulcrum;

a torsion spring in mechanical communication therewith said pressure adjustment knob at a first end and mounted along an outside surface of said center fulcrum and is anchored thereto;

said first mounting plate affixed thereto said center fulcrum at a second end of said torsion spring;

a locking lever comprising a lever washer mounted thereto said center fulcrum adjacent thereto said pressure adjustment knob; and, an incline plane feature along a front surface thereof said first left flange such that said incline plane is subjacent thereto said locking lever; and, a removable and interchangeable jaw pad attachable thereto said right and left jaw portions therewith said pad attachment means;

wherein said pad attachment means for each said right and left side members further comprises:

a mounting protrusion located on a rear portion thereof said jaw pad;

a pin aperture thereof said mounting protrusion; and, a restraining pin;

wherein said restraining pin is routed therethrough a pin aperture thereof a recessed mounting slot thereof said left and right jaw portions and said pin apertures, thereby providing said pad attachment means;

wherein said pad attachment means provide a pivoting attachment thereof said jaw pad thereto said left and right jaw portions, thereby providing a compliant inclusive angle to be achieved therebetween;

wherein said pressure adjustment knob is manually adjusted between a maximum force and a minimum in a clockwise or counter-clockwise direction to provide minute variations of an applied pressure exerted by said jaw pads thereupon said work object;

wherein when said pressure adjustment knob is manually adjusted, said torsion spring is compressed or released, thereby producing a variable torsion applied thereto said right side member via said first mounting plate;

wherein said locking lever provides a securing means thereto a desired torsion thereof said variable torsion thereto said clamp;

wherein when said locking lever is rotated clockwise about said center fulcrum, said incline plane forces said locking lever against a bottom surface of said pressure adjustment knob, thereby providing said securing means thereto; and, wherein said applied pressure is exerted by said jaw pads when said right handle and left handle portions are released;

wherein said clamp provides a compliant high-friction grip that ensures that said work object of varying size and shape is held with minimal or no movement;

wherein said center fulcrum provides relative motion thereof said right side member and left side member;

wherein an applied pressure thereto said left and right side members provides a separating means thereto said left jaw portion and said right jaw portion;

wherein said pressure adjustment means provides a selectable and variable clamping means thereto a work object;

wherein said first and second left flange comprise a width enabling said first and second left flange to bracket said first and second right flange;

wherein said first and second left flanged portion and said first and second right flanged portion each comprise apertures thereby allowing said center fulcrum to pass therethrough and provide a connection means thereof said second mounting plate thereof said left side member to said first mounting plate thereof right side member; and, wherein said center fulcrum terminates at a first end thereto a pressure adjustment knob and at a second end thereto said second mounting plate.

11. The clamp of claim 10, wherein said left side member further comprises pressure adjustment indicia being printed or etched thereupon and positioned adjacent thereto said pressure adjustment knob, thereby providing a directional indication as to minimum and maximum pressure adjustments.

12. The clamp of claim 11, wherein said jaw pads each comprise a firm jaw pad, further comprising a hard and non-marring material being suitable for performing tasks on said work object comprising rigid and durable materials.

13. The clamp of claim 11, wherein said jaw pads each comprise a soft jaw pad further comprising a pliable and conformable material being suitable to performing tasks on said work object comprising fragile materials.

14. The clamp of claim 11, wherein said handle grip further comprises a high-friction curved gripping surface having molded or coated layers of a soft pliable and gripping material having a plurality of parallel grooves or ridges.

15. A method of operating a hand-held spring clamp which provides an aid in an assembly of a work object, comprising the steps of:

obtaining a hand-held spring clamp, comprising:

a right side member further comprising:

a removably attachable pad attachment means at a right jaw portion at a right upper end;

a first right flange located at a right central location;

a second right flange located at said central location;

a first mounting plate located on a front side of said second right flange; and, a right handle portion having a right handle grip;

a left side member further comprising:

a removably attachable pad attachment means at a left jaw portion located at left upper end;

a first left flange located at a left central location;

a second left flange located at said central location;

a second mounting plate located on a rear surface of said second left flange; and, a left handle portion having a left handle grip;

a center fulcrum providing a pivoting means thereto said right and left central location;

a pressure adjustment means affixed thereto said center fulcrum, further comprising:

a pressure adjustment knob mounted thereto a centrally located position about an axis of a first end of said center fulcrum;

a torsion spring in mechanical communication therewith said pressure adjustment knob at a first end and mounted along an outside surface of said center fulcrum and is anchored thereto;

said first mounting plate affixed thereto said center fulcrum at a second end of said torsion spring;

a locking lever comprising a lever washer mounted thereto said center fulcrum adjacent thereto said pressure adjustment knob; and, an incline plane feature along a front surface thereof said first left flange such that said incline plane is subjacent thereto said locking lever; and, a first and a second removable and interchangeable jaw pad attachable thereto said right and left jaw portions therewith said pad attachment means;

removing all restraining pins therefrom pin apertures thereof said right and left jaw portions;

determining if said work object requires a soft jaw pad or a firm jaw pad as sa first or second jaw pad;

sliding a mounting protrusion thereof said first and second jaw pad thereinto a recessed mounting slot portion of both said right and left jaw portions such that pin apertures of said mounting protrusion of said first and second jaw pad is aligned with pin apertures of said right and left jaw portions, respectively;

replacing all restraining pins thereinto pin apertures of said left and right jaw portion and pin apertures thereof said mounting protrusion of said first and second jaw pad, thereby achieving said pad attachment means;

determining a desired pressure to be provided by said clamp thereto said work object;

turning said pressure adjustment knob in a clockwise or counter-clockwise direction using pressure adjustment indicia located thereon said clamp until said desired pressure is reached;

locking said pressure adjustment knob in place by rotating said locking lever in a clockwise direction;

applying a hand pressure thereto said right and left handle grip, thereby opening said right and left jaw portions and subsequently said first and second jaw pads;

using said clamp to clamp an work object based upon a particular craft or shop task;

releasing said hand pressure applied thereto said right and left handle grip to close said right and left jaw portions and subsequently said first and second jaw pads thereupon said work object, thereby applying said desired pressure thereto said work object;

performing desired work thereon said work object while being retained therein said clamp; and, removing said work object by applying said hand pressure thereto said right and left handle grip thereby opening said right and left jaw portions and subsequently said first and second jaw pads.

* * * * *